United States Patent [19]

Kornberger

[11] 4,455,803

[45] Jun. 26, 1984

[54] APPARATUS FOR SEALING FLAT ELEMENTS TOGETHER, PARTICULARLY ROOF ELEMENTS

[75] Inventor: Otto Kornberger, Hettstadt, Fed. Rep. of Germany

[73] Assignee: MERO-Raumstruktur GmbH & Co. Wurzburg, Fed. Rep. of Germany

[21] Appl. No.: 408,183

[22] Filed: Aug. 16, 1982

[30] Foreign Application Priority Data

Aug. 17, 1981 [DE] Fed. Rep. of Germany ... 8123976[U]

[51] Int. Cl.[3] ..... E04B 7/00

[52] U.S. Cl. ..... 52/395; 52/81; 52/469; 52/464

[58] Field of Search ..... 52/80, 81, 86, 394, 52/395, 471, 467, 466, 460, 401, 584

[56] References Cited

U.S. PATENT DOCUMENTS

| | | | |
|---|---|---|---|
| 2,412,242 | 12/1946 | Beard | 52/461 |
| 3,192,669 | 7/1965 | Hawkins | 52/81 |
| 3,423,896 | 1/1969 | Widerby | 52/471 |
| 3,557,501 | 1/1971 | Kolozsvary | 52/81 |
| 3,868,802 | 3/1975 | Schubach | 52/471 |
| 3,909,994 | 10/1975 | Richter | 52/81 |
| 4,075,811 | 2/1978 | Keith | 52/471 |
| 4,297,825 | 11/1981 | Harper | 52/81 |

FOREIGN PATENT DOCUMENTS

| | | | |
|---|---|---|---|
| 1011881 | 12/1965 | United Kingdom | 52/461 |

*Primary Examiner*—Henry E. Raduazo

*Attorney, Agent, or Firm*—Jacobi, Siegel, Presta, Marzullo & Aronson

[57] ABSTRACT

Apparatus for the sealing of flat roof elements or the like which are supported at their corners, comprising a bowl-shaped part disposed on the outside edge of the roof elements in the area of the top edges thereof, the bowl-shaped part running substantially parallel to these edges. A sealing tape is placed in the bowl-shaped part, and a cover rail having arms bent downwardly at an angle is provided for engagement with any two adjacent roof elements in the bowl-shaped part. The cover rail serves to press the sealing tape by means of screws which are inserted between the cover rail and the adjacent roof elements beneath the rail.

3 Claims, 4 Drawing Figures

APPARATUS FOR SEALING FLAT ELEMENTS TOGETHER, PARTICULARLY ROOF ELEMENTS

BACKGROUND OF THE INVENTION

The present invention relates to a device for sealing flat elements together, particularly roof elements which are supported in their corners, e.g., by a space framework.

With the sealing together of flat elements in buildings, preferably roof elements, difficulties frequently arise in that the elements to be sealed together project outwardly and do not always sufficiently fulfill their sealing function, for instance, during displacement caused by heat. Also, it is generally difficult to simply and rapidly exchange the flat elements, without renewal of the seal and without the appearance of some kind of damage.

The present invention avoids the above drawbacks and improves the sealing together of flat elements, particularly on a space framework.

SUMMARY OF THE INVENTION

According to the present invention, a bowl-shaped part is provided on the outside edges of the roof elements, in the vicinity of their top edges, running substantially parallel to the edges, in which is placed a sealing tape, and a cover rail with arms bent downwardly at an angle is provided for engagement with any two adjacent roof elements in the bowl-shaped part. The cover rail serves to press the sealing tape by means of screws, which are inserted between the cover rail and the adjacent roof elements beneath the rail.

Thus, it is advantageously possible to attach the cover rail and the sealing tapes flush on the adjacent tops of the roof elements, thereby avoiding having parts projecting over the roofing, particularly on the support points, which simplifies the sealing of these points. The arms of the cover rail bent at an angle are used to press the sealing tapes, to attain an effective seal, which functions even with expansion or contraction of the flat roof elements caused by heat or cold. The arms of the cover rail turned down at an angle also prevent lateral slippage. Finally, the assembly of the roof elements is simplified by this invention, because the elements need to be supported only at their corners, with the sealing tapes inserted in the bowl-shaped part of the roof element and the cover rail inserted and braced, and at the same time the cover rail advantageously bridges the narrow spaces between the separate flat roof elements.

According to another embodiment of the invention, a cover plate with at least one annular stiffening corrugation or groove can be mounted at a fastening point of the roof element on a space framework, to receive a sealing ring over the roof element, and these are arranged to engage flush with cover rails by bridging over the space.

According to still another embodiment of the invention, at least the outside of the arms of the cover rail bent down at an angle run obliquely inwardly, and the pressing of the sealing tapes is improved further because of the wedge effect, and therewith also the sealing of the roof element.

If the flat elements or roof elements are, e.g., of foam sandwich construction, the sealing tapes according to another modification of the invention could fulfill still another function. In this version, a strip-like flange of the inside top longitudinal edge of the bowl-shaped part of the profiled strip is curved substantially parallel to the plane of the roof element, and a part of the sealing tape from the bowl-shaped part of the profiled strip extends over the strip flange and is clamped between a cover sheet of the roof element and sealed to the strip flange.

Although the invention finds its main use in the sealing of flat roof elements, it is also suitable for any situation in which flat elements, for instance, form the covering of outside walls of buildings.

BRIEF DESCRIPTION OF THE DRAWINGS

The invention is explained hereinafter relative to the drawings of exemplary embodiments. They show.

DESCRIPTION OF THE PREFERRED EMBODIMENTS

Figure 1:
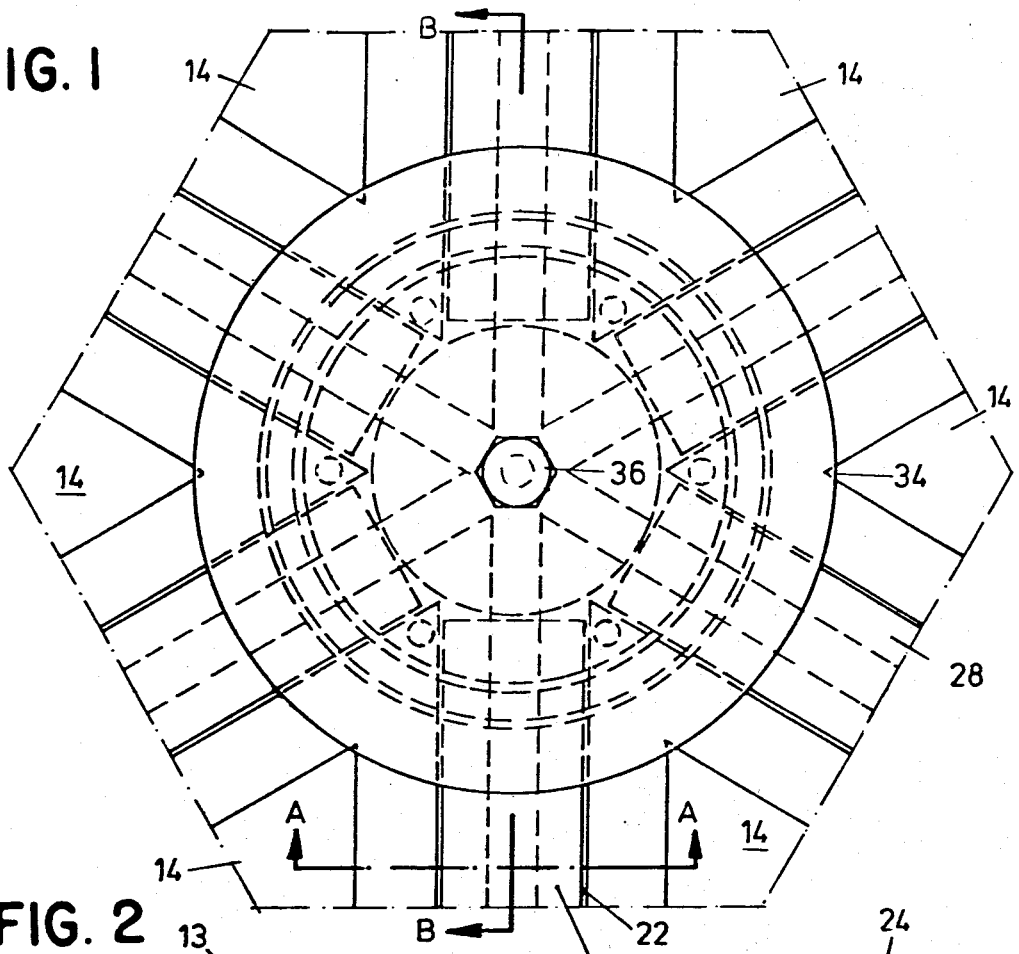
FIG. 1 is a plan view of a cutout of a dome-shaped construction in the area of one support point for flat roof elements with a triangular ground plan.
Figure 3:
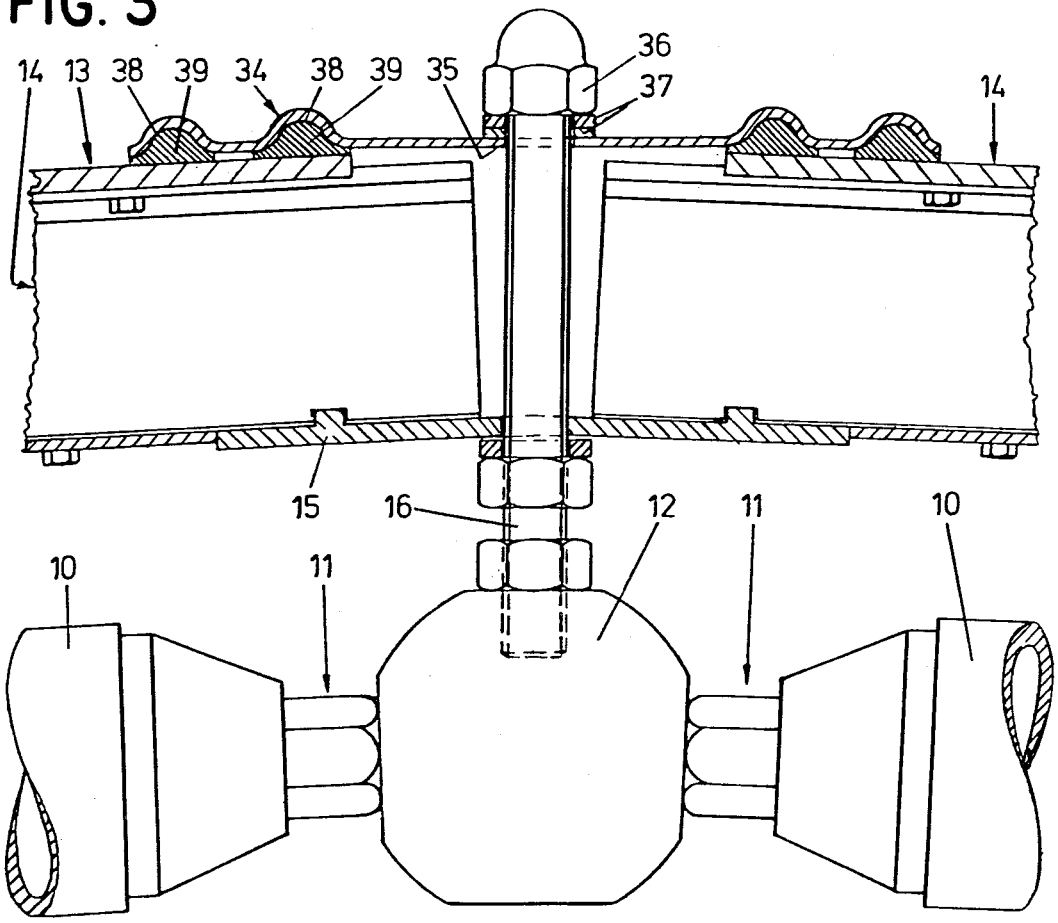
FIG. 3 is another partial sectional view taken along line B—B of FIG. 1.

In FIG. 3, the ends 10 of two rods are tightly connected by screw connections 11 with an articulation element 12 and form parts of a dome-shaped space framework, which supports roofing 13. FIGS. 1 and 3 show one support point of roofing 13 on the space framework. Roofing 13 is made up of separate flat roof elements 14 with triangular ground plan. Roof elements 14 are supported with their corners on a support plate 15, which is supported in turn by a threaded bolt 16, which is screwed into one of the threaded bores (not shown) of the articulation elements 12, of which the axes intersect in the middle of the articulation element.

Roof elements 14 each have a frame made up of profiled strips 17, e.g., of aluminum, on their outside periphery, to which are screwed an outside cover sheet 18 and an inside cover sheet 19. These cover sheets could also be aluminum, and the outside is preferably covered with plastic. Cover sheets 18, 19 together with the frame of profile strips 17 form a hollow body which is filled with a rigid foam material 20.

The profiled strips 17 on a frame each have a bowl-shaped part 21, which runs parallel to the edges around the entire periphery of each roof element 14. A sealing tape 22 of a suitable elastic material is inserted into each of these bowl-shaped parts 21, which are also circular. A strip flange 23 is curved parallel to the plane of the plate on the inside of the top longitudinal edge of bowl-shaped part 21 of each profile strip 17. A part 24 of the sealing tape 22 overlaps this strip flange 23 and is clamped and sealed between this and an edge of outside cover sheet 18. It is to be noted that also this part 24 of sealing tape 22 runs around the entire periphery of roof element 14. Part 24 is clamped in by means of threaded bolt 25 on outside cover sheet 18 and nuts 26 screwed onto this. Instead of part 24 being adapted in shape to sealing tape 22, a separate sealing tape could also be used.

Figure 2:
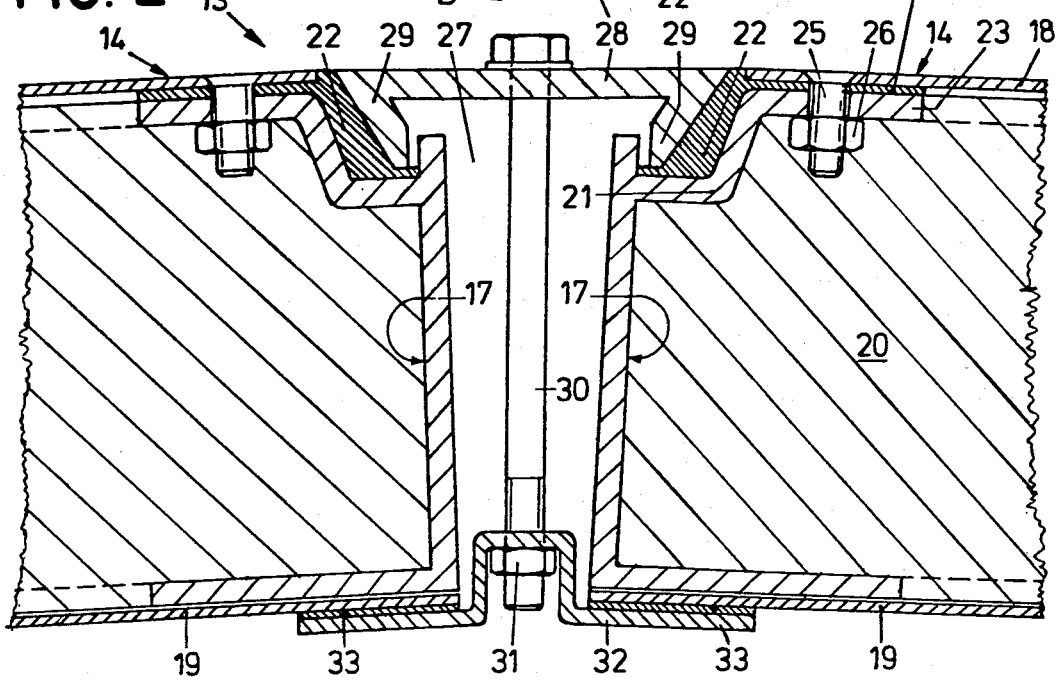
FIG. 2 is a partial sectional view taken along line A—A of FIG. 1.

In FIGS. 1 and 2, it is clear that roof elements 14 are mounted on each support plate 15 so that narrow spaces 27 are present between the profiled strips 17 of adjacent roof elements 14. These are covered by cover rails 28, which have angled arms 29 on their opposite longitudinal edges. At a desired spacing, screw bolts 30 extend further down through cover rails 28 into spaces 27 and then through bores in a strip 32 with a cap-shaped section. With nuts 31 screwed on screw bolts 30, which engage against the bottom of strip 32, cover rails 28 can be pressed with their arms 29 against sealing tapes 22 in such a manner as to attain both an effective seal of the roof elements 14 and a flush connection of the cover rails 28, sealing tapes 22 and cover sheets 18 with the adjacent roof elements 14. It is also to be noted that between each strip 32 and the bottom of the adjacent roof elements 14 are clamped more sealing tapes 33.

Roof elements 14 are sealed on the outside in the area of their fastening or mounting points by means of a circular cover plate 34, which overlaps the corners of roof elements 14 and cover rails 28, bridging over these to the extent shown in FIG. 1. Aluminum cover plate 34 has a middle bore 35 for fitting on threaded bolt 16 and is covered by a cap nut 26 over washers 37 in sealed position. Cover plate 34 has two annular, concentric stiffening corrugations 38 on its inside, in which are placed two sealing rings 39, which are pressed against cover sheet 18 during withdrawal of cap nut 36 against cover sheet 18 of roof element 14 or cover rails 28.

Figure 4:
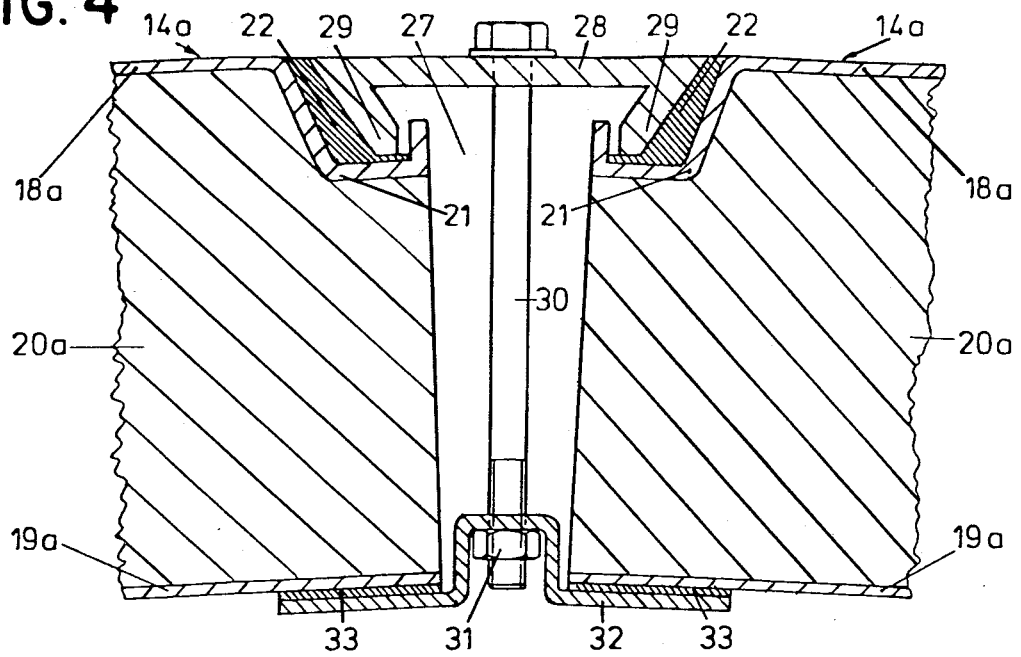
FIG. 4 is a partial sectional view similar to FIG. 2, of a modification of the invention.

FIG. 4 discloses a modified form of the invention using roof elements **14*a* which differ from the roof elements 14. The roof elements 14*a* essentially comprise a plate-shaped core 20*a*, e.g., a rigid foam plate, of wood, rock wool or light concrete. This plate-shaped core 20*a* has a cover sheet 18*a* on the top and a cover sheet 19*a* on the bottom. Differing from the embodiment of FIG. 2, the bowl-shaped part 21 is constructed along the periphery of roof element 14*a* on the outside edge of cover sheet 18*a* and the core plate 20*a* includes a suitable round cutout for the bowl-shaped part 21 on the cover sheet 18*a*. This embodiment otherwise corresponds to that of FIG. 2** and the same parts are therefore indicated with the same numbers.

What is claimed is:

1. Apparatus for the sealing of flat elements, particularly roof elements, which are supported at their corners, e.g., by a space framework, characterized in that a bowl-shaped part (21) is provided on the outside edge of the roof elements (14) in the area of the top edges thereof, and runs substantially parallel to said edges; a sealing tape (22) is placed in said bowl-shaped part; and that for engagement of any two adjacent roof elements (14) in the bowl-shaped part (21), a cover rail (28) with arms (29) extending downwardly at an angle is provided, said arms being adapted to compress sealing tape (22) by means of securing means (30), which are inserted between cover rail (28) and the adjacent roof elements (14) beneath the rail, said bowl-shaped parts (21) being provided in profile strips (17) which define the outside periphery of roof elements (14) connected to a frame, and that a strip flange (23) extends in substantially parallel relation to the plane of roof element (14) from the inside top longitudinal edge of the bowl-shaped part (21) of a profile strip (17), and that a part (24) of the sealing tape (22) from the bowl-shaped part (21) of profiled strip (17) extends outwardly over strip flange (23) and is clamped and sealed between a cover sheet (18) of roof element (14) and strip flange (23).

2. Apparatus as in claim 1, characterized in that the outer surfaces of arms (29) of cover rails (28) are bent downwardly at an angle and run obliquely inwardly.

3. Apparatus as in claim 1, characterized in that a cover plate (34) with at least one annular stiffening corrugation or groove (38) is provided at a fastening point of roof elements (14), and a packing ring (39) is disposed in said groove (38) in engagement with the roof elements (14).

* * * * *